US005184940A

United States Patent [19]

Fujiwara et al.

[11] Patent Number: 5,184,940

[45] Date of Patent: Feb. 9, 1993

[54] FLUID COMPRESSOR

[75] Inventors: Takayoshi Fujiwara, Kawasaki; Hisanori Honma; Yoshinori Sone, both of Yokohama, all of Japan

[73] Assignee: Kabushiki Kaisha Toshiba, Kawasaki, Japan

[21] Appl. No.: 723,326

[22] Filed: Jun. 28, 1991

[30] Foreign Application Priority Data

Jun. 29, 1990 [JP] Japan ..... 2-170268
Jun. 29, 1990 [JP] Japan ..... 2-170269

[51] Int. Cl.[5] ..... F04C 18/16

[52] U.S. Cl. ..... 417/356; 418/220

[58] Field of Search ..... 417/355, 356; 418/220, 418/164, 178

[56] References Cited

U.S. PATENT DOCUMENTS

| | | | |
|---|---|---|---|
| 2,401,189 | 5/1946 | Quiroz | 418/220 |
| 2,953,993 | 9/1960 | Strickland | 417/356 |
| 4,871,304 | 10/1989 | Iida et al. | 418/220 |
| 4,875,842 | 10/1989 | Iida et al. | 418/220 |
| 4,997,352 | 3/1991 | Fujiwara et al. | 418/364 |
| 5,026,264 | 6/1991 | Morozumi | 417/356 |
| 5,062,778 | 11/1991 | Hattori | 418/220 |
| 5,090,874 | 2/1992 | Aikawa | 417/356 |
| 5,090,875 | 2/1992 | Aikawa | 417/356 |

FOREIGN PATENT DOCUMENTS

| | | | |
|---|---|---|---|
| 3830746 | 3/1989 | Fed. Rep. of Germany | 418/220 |

*Primary Examiner*—Richard A. Bertsch

*Assistant Examiner*—Peter Korytnyk

*Attorney, Agent, or Firm*—Cushman, Darby & Cushman

[57] ABSTRACT

A fluid compressor is provided which includes a closed case having a case body with an open end and cover for closing the open end of the case body to house drive compressor sections and therein. The compressor section has a cylinder having an axial line and both ends located on sucking and discharging sides thereof, rotated by the drive section, a rotating body provided with an axial line offset to the axial line and a spiral groove formed on the outer circumference thereof at such a pitch that becomes smaller and smaller as it comes from the sucking side end thereof nearer to the discharging side thereof, and arranged to contact a part of the outer circumference thereof with the inner circumference of the cylinder. The compressor section also includes a spiral blade made of rigid material and arranged in the spiral groove of the rotating body to be freely slidable in the radial direction of the rotating body while keeping its outer circumference closely contacted with the inner circumference of the cylinder to partition a space between the cylinder and the rotating body into plural operating chambers, and a rotation force transmitting system for connecting the cylinder and the rotating body to drive them. The compressor section is supported directly by the closed case through a bearing located on the sucking side of the cylinder. Another bearing located on the discharging side of the cylinder is supported, movable relative to the closed case, by a support plate.

12 Claims, 6 Drawing Sheets

FLUID COMPRESSOR

BACKGROUND OF THE INVENTION

1. Field of the Invention

The present invention relates to a fluid compressor for compressing refrigerant gas in a refrigerating cycle, for example.

2. Description of the Related Art

There have been well known compressors of various types such as those of reciprocating and rotary types. In these compressors, however, the drive system which includes crankshafts and the like to transmit rotating force to the compression system is complicated in structure. The compression system itself is also complicated in structure. This causes the number of parts to be increased. Further, these compressors need a check valve on their discharging side in order to increase compressive efficiency, but because pressure difference on both sides of this check valve is quite large, gas is likely to leak through the check valve to thereby lower compressive efficiency. In order to solve these problems, the accuracy of parts dimension and assembly must be enhanced. This makes the manufacturing cost of these compressors high.

Therefore, some fluid compressors have been proposed which are capable of eliminating the above-mentioned drawbacks, enhancing their sealing, being simpler in structure, to achieve a compression of higher efficiency, and being more easily manufactured and assembled.

U.S. Pat. No. 4,871,304, for example, discloses one of these fluid compressors, that is, compressor of the closed type suitable for use with the refrigeration cycle device, for example, to compress and discharge refrigerant gas.

The compressor body comprises motor and compression components housed in a closed case.

When power is added to the motor component and a cylinder which is one of the compressor components is rotated, the rotation of the cylinder is transmitted to a piston which serves as a rotating body through a rotation force transmitting system. The piston is rotated while contacting a part of its outer surface with the inner surface of the cylinder and a blade fitted in a groove on the outer area of the piston is also rotated together with the piston.

The blade is rotated while contacting its outer surface with the inner surface of the cylinder. Therefore, its part which comes nearer to a point where the outer surface of the piston is contacted with the inner surface of the cylinder is pushed into the groove on the outer area of the piston further and further but it is projected from the groove further and further as it becomes more remote from the contact point between the piston and the cylinder.

Following this compressing operation, refrigerant gas is sucked into the cylinder through sucking tube and passage. While being closed in operating chambers which are partitioned by the blade between the cylinder and the piston, the refrigerant gas is gradually transferred from the sucking side of the closed case to the discharging side thereof as the piston is rotated, and every time it is transferred to the operating chamber which is nearer the discharging side of the closed case, it is further compressed. The refrigerant gas thus compressed is discharged into a space in the closed case through a discharging hole and then returned to the refrigeration cycle through a discharging tube.

In the case of this fluid compressor, both ends of the cylinder and the piston which are compressor components are freely rotatably supported by a main bearing and by a sub-bearing. In short, the both ends of the cylinder and the piston are rotatably supported. In addition, diametrical centers of inner and outer bearing surfaces of the respective bearings are eccentricaly set with each other because a part of the outer surface of the piston must be contacted with the inner surface of the cylinder in the axial direction thereof.

When positions of the main- and sub-bearings fixed relative to the closed case are deviated from desired locations even a little the parallel relation between the piston and the cylinder cannot be kept with high accuracy even if inner and outer diameter dimensions of the main- and sub-bearings which freely rotatably support both ends of the cylinder and the piston are made with high accuracy.

The main and sub-bearings are attached and fixed to the closed case by welding or screws. However, the thickness of the closed case is relatively small but the main- and sub-bearings are circular blocks. The thermal distortion of the closed case caused by welding is therefore different from those of the main- and sub-bearings, thereby making it difficult to accurately attach and fix the main- and sub-bearings to the closed case. Accordingly, the parallel relation between the cylinder and the piston cannot be made high in accuracy. When screws are used, at least the closed case must be provided with holes into which the screws can be easily inserted, thereby making it difficult to attach and fix the main- and sub-bearings to the closed case with high accuracy.

It is naturally desired that the cylinder and the piston are supported at their both ends, that is, the both ends supporting structure is employed, but their attaching and fixing accuracy is a problem, as described above.

In order to solve this problem, U.S. Pat. No. 4,875,842 discloses a fluid compressor having compressor components of the cantilevered design, wherein a bearing member for supporting the cylinder and the piston at one ends thereof is attached and fixed to the closed case and the other ends thereof are provided with only detents. More specifically, the main bearing is attached and fixed to the closed case and the sub-bearing is formed as a plate spring. The piston and the cylinder are supported by a support system while being elastically urged to the side of the main bearing.

In the case of the compressor components of this kind, the attaching and fixing accuracy of the piston and the cylinder relative to the closed case can be achieved, but when force is added to the piston and the cylinder in the traverse direction thereof, a large moment is caused and galling is thus caused at those portions of the piston and the cylinder which are slidably contacted with each other as well as at the bearings.

SUMMARY OF THE INVENTION

The present invention is therefore intended to eliminate the above-mentioned drawbacks and the object of the present invention is to provide a fluid compressor wherein a bearing member, for example, located on the one side of a closed case is supported freely movable on a plane perpendicular to axial center lines of a cylinder and a piston and when the position of this bearing member is correctly set, the attaching and fixing accuracy of the cylinder and the piston relative to the closed case can be enhanced and these cylinder and piston can be supported as if they were supported at their both ends.

The object of the present invention can be attained by a fluid compressor comprising a closed case having a case body provided with an open end and cover for closing the open end of the case body to house drive and compressor sections therein, said compressor section including a cylinder provided with an axial line and first and second ends and being rotated by the drive section, a rotating body provided with an axial line offset relative to the axial line of the cylinder and a spiral groove formed on the outer region thereof with pitch decreasing at a predetermined rate, and arranged to contact a part of the outer circumference thereof with the inner circumference of the cylinder, a spiral blade made of elastic material, arranged in the groove of the rotating body to freely slide in the radial direction of the rotating body and provided with an outer circumference closely contacted with the inner circumference of the cylinder to partition a space between the cylinder and the rotating body into plural operating chambers, and a rotation force transmitting system for connecting the cylinder and the rotating body to drive them; a pair of fixing bearings, one of which is fixed directly to the closed case, serving to support the cylinder and the rotating body rotatable in relation to the closed case and close the sucking and discharging sides ends of the cylinder; a support means having an engaging mean attached to the other of the paired bearings and serving to support the other bearing movable in relation to the closed case at least in a certain range on a plane perpendicular to axial center lines of the cylinder and the rotating body and a positioning mean formed at least at one of the case body and the cover to position the engaging means relative to the closed case.

According to the present invention, the positioning of the bearing member particularly located on the discharging side of the closed case can be correctly achieved by the positioning means. Further, when the bearing member, for example, located on the discharging side is attached and fixed to the closed case, undesired thermal influence cannot be caused, thereby preventing component parts from being deformed by heat. Therefore, assembling workability can be enhanced and cost can be made lower. Furthermore, compressing capacity can be enhanced because the both ends supporting structure can be substantially created relative to the cylinder and the rotating body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be described with reference to the accompanying drawings.

Figure 1:
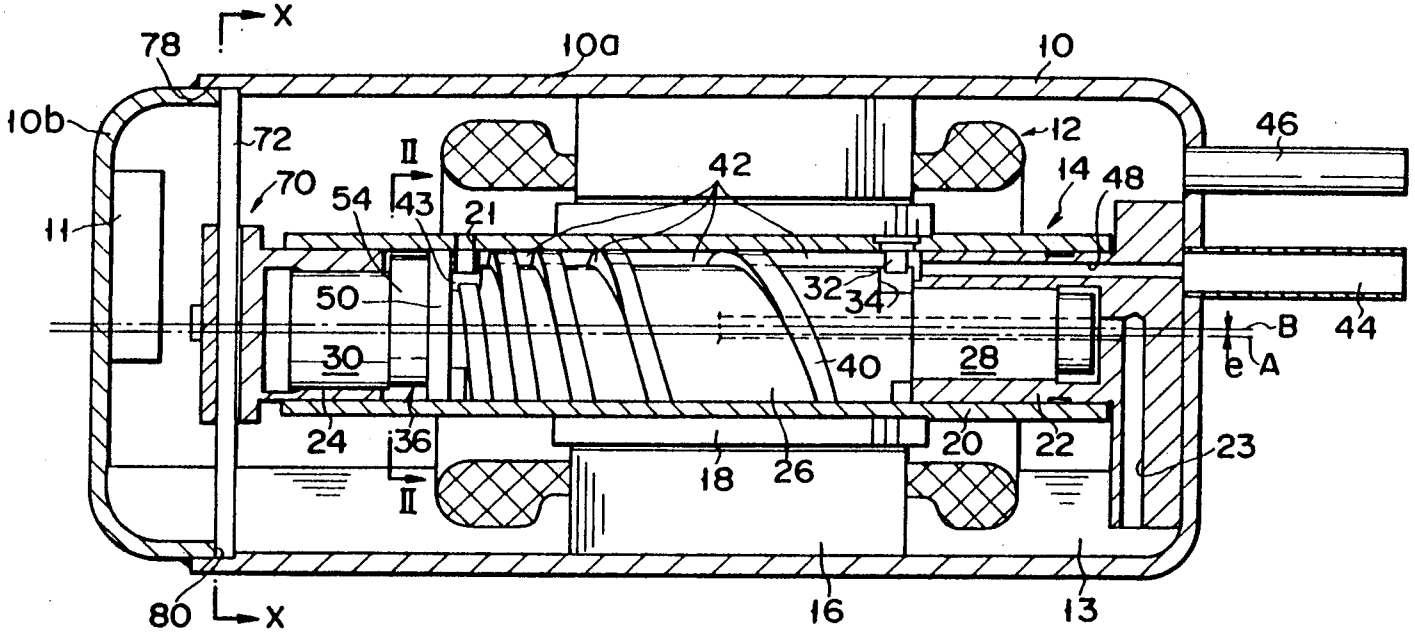
FIG. 1 is a vertically-sectioned side view schematically showing the fluid compressor according to an embodiment of the present invention.

As shown in FIG. 1, a compressor body comprises electromotive driving and compressing sections 12 and 14 housed in a closed case 10. The driving section 12 has a ring-shaped stator 16 fixed to the inner face of the closed case 10, and a ring-shaped rotor 18 arranged inside the stator 16. The stator 16 is electrically connected to a connector block 11, which is connected to an outside power source, through an electric wire (not shown). Reference numeral 13 denotes lubricating oil housed in the closed case 10.

The compressing section 14 has a cylinder 20, to the outer circumference of which the rotor 18 is fixed. Both ends of the cylinder 20 are freely rotatably supported by main and sub-bearings 22 and 24 which serve as sucking and discharging sides bearing members fixed to the inner face of the closed case 10 by welding or the like. Both ends of the cylinder 20 are also sealingly closed by the main and sub-bearings 22 and 24.

The main bearing 22 is fixed to the inner wall of the closed case 10 by welding or screws. The main bearing 22 is provided with a passage 23 through which the lubricating oil 13 in the closed case 10 is supplied into the cylinder 20. The lubricating oil 13 is sup plied to proper portions in the cylinder 20 by the pressure of discharged gas in the closed case 10.

The sub-bearing 24 is attached to the closed case 10 through a support system 70.

Further, sucking and discharging pipes 44 and 46 of the refrigeration cycle are connected to the closed case 10. The sucking pipe 44 is communicated with a sucking hole 48 in the main bearing 22 and the discharging pipe 46 is communicated with the inside of the closed case 10.

A piston 26 which serves as a columnar rotating body is housed in the cylinder 20 at the compressing section 14 along the axial direction of the cylinder 20. Those portions 28 and 30 which are extended and projected from both ends of the piston 26 in the axial direction thereof are freely rotatably supported in the bearings 22 and 24. A center axis (A) of the piston 26 is eccentrically arranged to that (B) of the cylinder 20 only by a small distance (e) and a part of the outer surface of the piston 26 is contacted with the inner surface of the cylinder 20 in the axial direction thereof.

On the other hand, an engaging groove 32 is formed on the sucking side end of the piston 26, radially inwardly extending from the outer circumference of the piston 26. A drive pin 34 projected from the inner circumference of the cylinder 20 is freely reciprocated into and out of the engaging groove 32 in the radial direction of the cylinder 20. An Oldham system 36 which transmits the rotating force of the cylinder 20 to the piston 26 to synchronously rotate the cylinder 20 and the rotating body 26 while displacing them to each other is located at the discharging side end of the piston 26. This Oldham system 36 will be later described in detail. The engaging groove 32, drive pin 34 and Oldham system 36 form a rotating force transmitting means. The rotating force transmitting means in this case includes the engaging groove 32 and the drive pin 34, and the Oldham system 36, but it is apparent that either of the engaging groove 32 and the drive pin 34 or the Oldham system 36, particularly the former may be omitted.

A spiral groove 38 (FIG. 2) which extends between both ends of the piston 26 from right to left in FIG. 1 and whose pitch becomes smaller as it comes nearer to the discharging side of the cylinder 20 is formed on the outer circumference of the piston 26 housed in the cylinder 20. A spiral blade 40 is fitted into the groove 38. The blade 40 is made of elastic material such as Teflon (trade name). The width of the blade 40 is substantially equal to that of the groove 38. The blade 40 can freely reciprocate into and out of the groove 38 in the radial direction of the piston 26 while its outer surface closely contacting to the inner surface of the cylinder 20.

Figure 2:
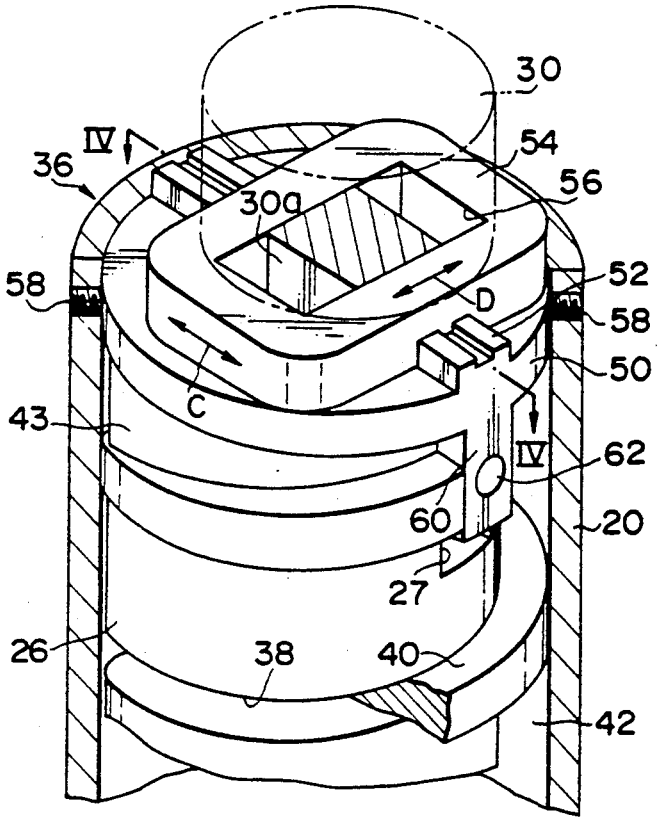
FIG. 2 is a perspective view taken along a line II—II in FIG. 1.

As shown in FIGS. 1 and 2, a space between the inner surface of the cylinder 20 and the outer surface of the piston 26 is partitioned into plural operating chambers 42 by the blade 40. Each of the operating chambers 42 is shaped substantially semicircular, extending from that portion of the piston 26 which is contacted with the inner circumference of the cylinder 20 to their next contacted portion along the blade 40, and volumes of the operating chambers 42 gradually become smaller as they come nearer the left discharging side of the cylinder 20. The most leftwardly located operating chamber 43 serves as a discharging chamber.

As the most clearly shown in FIG. 2, the Oldham system 36 includes a disk-like Oldham seat 50 and an Oldham ring 54. The Oldham seat 50 has a key 52 projected from its one side opposed to the discharging chamber 43 and its outer diameter is set substantially equal to the inner diameter of the cylinder 20 to contact its outer surface with the inner surface of the cylinder 20. The Oldham ring 54 is arranged along that side of the Oldham seat 50 on which the key 52 is formed, and it has a rectangularly formed ring hole 56.

Figure 3:
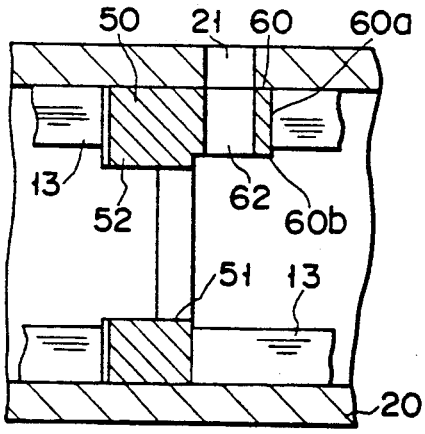
FIG. 3 is a sectioned side view showing an Oldham seat arranged in the cylinder.

As shown in FIG. 3, the outer surface of the Oldham seat 50 is air-tightly contacted with the inner surface of the cylinder 20. The Oldham seat 50 is fixed to the cylinder by threaded screws 58 (FIG. 2) into the cylinder 20 in the radial direction thereof.

As shown in FIG. 2, the key 52 of the Oldham seat 50 is toothed with a key groove of the Oldham ring 54, which can slide relative to the Oldham seat 50 in directions C. Further, a discharging side shaft 30 of the piston 26 passes through an opening 51 of the Oldham seat 50 and the ring hole 56 of the Oldham ring 54, and an engaging portion 30*a* of the discharging side shaft 30 which has a rectangular section can slide along the ring hole 56 of the Oldham ring 54 in directions D. Therefore, the Oldham system 36 transmits the rotating force of the cylinder 20 to the piston 26 while causing the Oldham ring 54 to be slid relative to the Oldham seat 50 in the directions C and the piston 26 to be slid relative to the Oldham ring 54 in the directions D, and it synchronously rotates the cylinder 20 and the piston 26 while causing them to be displaced to each other.

Further, the Oldham system 36 is provided with a blade stopper 60. This blade stopper 60 is shaped like a rectangular pillar and projected from that side of the Oldham seat 50 which is located on the sucking side of the cylinder 20. The blade stopper 60 extends from the outer rim of the Oldham seat 50 and it is located in opposite to the key 52. It enters into a recess 27 which is formed at the piston 26 on the discharging side thereof and which is open at one end face and outer circumference of the piston 26. Formed between the blade stopper 60 and the discharging side recess 27 is a clearance large enough to allow the blade stopper 60 to enter into the recess 27 without contacting each other when the cylinder 20 and the piston 26 are being rotated relative to each other. The blade stopper 60 faces that end of the blade 40 which enters into the discharging side recess 27, while causing the discharging side end face of the blade 40 to be struck against one side of the blade stopper 60, as shown in FIG. 2.

Furthermore, the blade stopper 60 is provided with an Oldham seat discharging hole 62. This Oldham seat discharging hole 62 extends substantially parallel to the radial direction of the Oldham seat 50 and passes through the blade stopper 60, opening like a circle at inner and outer circumferences 60*a* and 60*b* of the blade stopper 60. The Oldham seat discharging hole 62 is positioned by fixing the Oldham seat 50 to the cylinder 20 and the opening of the Oldham seat discharging hole 62 at the outer circumference 60*a* of the blade stopper is caused to face the opening of a cylinder discharging hole 21, thereby communicating the cylinder discharging hole 21 with the discharging chamber 43 (FIG. 3).

Figure 4:
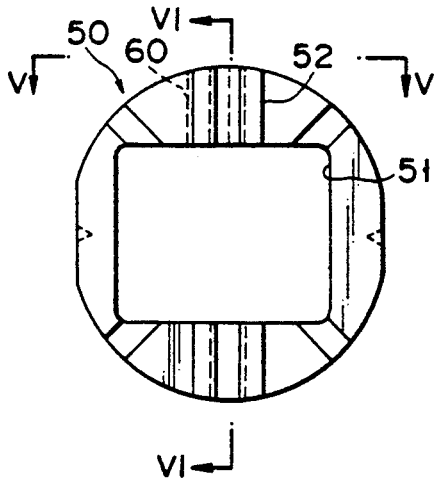
FIG. 4 is a sectional view taken along a line IV—IV in FIG. 2 and showing the Oldham coupling.
Figure 5:
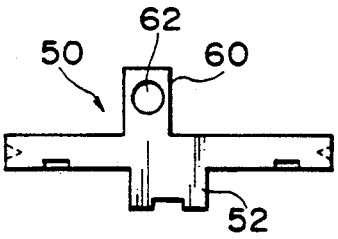
FIG. 5 is a sectional view taken along a line V—V in FIG. 4.
Figure 6:
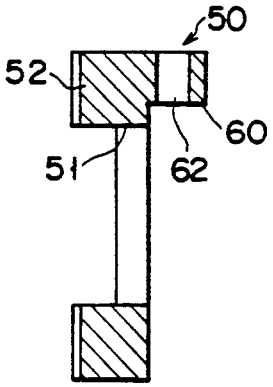
FIG. 6 is a sectional view taken along a line VI—VI in FIG. 4.

FIGS. 4 through 6 show this Oldham seat 50 in detail.

Figure 7:
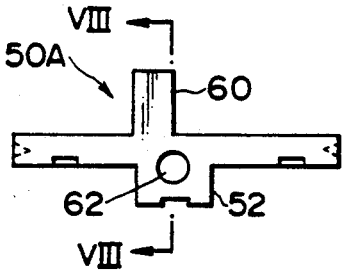
FIGS. 7 and 8 are sectional views, similar to FIGS. 5 and 6, showing a variation of the Oldham seat.
Figure 8:
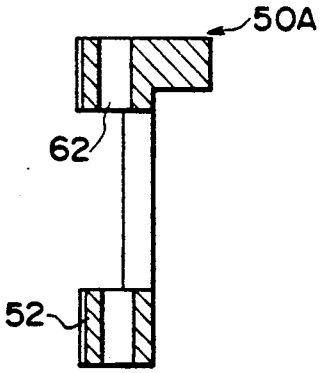

FIGS. 7 and 8 show a variation 50A of the Oldham seat. In this Oldham seat 50A of the Oldham seat discharging hole 62 is formed in the key 52. The Oldham seat discharging hole 62 may be formed at any appropriate position as well.

The support system 70 which supports the cylinder 20 and the piston 26 on their discharging sides will be described referring to FIGS. 1 and 9 through 12.

As shown in FIG. 1, the support system 70 supports the sub-bearing 24 movable on a plane perpendicular to the axes A and B of the cylinder 20 and the piston 26.

As shown in FIGS. 9 through 12, the support system 70 includes a support plate 72 fixed to the closed case 10 at its upper and lower ends, an engaging member 74 fixed to the sub-bearing 24, and engaging screws 76 for fixing the support plate 72 and the engaging member 74.

The support plate 72 is shaped like a rectangular plate and fixed to the closed case 10 while keeping its face substantially perpendicular to the axial direction of the cylinder 20.

The engaging member 74 is shaped in a rectangular plate and has a guide portion 74*a* which is projected and extended straight along the center line of the engaging member 74, having a U-shaped section. Further, it faces the sub-bearing 24 with the support plate 72 interposed between them and with the inner face of its guide portion 74*a* directed to the end face of the sub-bearing 24. Still further, it has a pair of engaging grooves 74*b* on a line perpendicular to the longitudinal direction of its guide portion 74*a*.

The engaging screws 76 are of the stepped type and they are screwed into the sub-bearing 24 through the engaging grooves 74*b* of the engaging member 74 but kept freely slidable in the longitudinal direction of the engaging grooves 74*b* which is perpendicular to the longitudinal direction of the engaging member 74.

Figure 9:
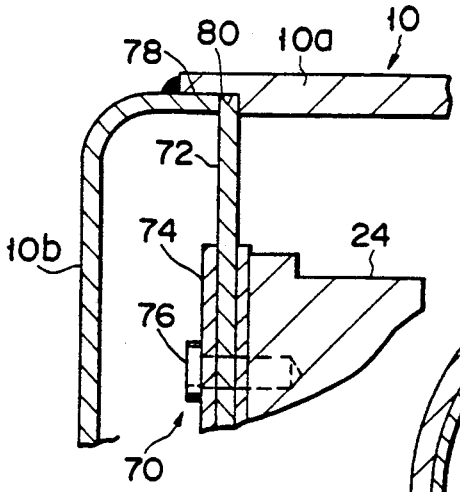
FIG. 9 is a vertically-sectioned view showing a part of FIG. 1 enlarged.
Figure 10:
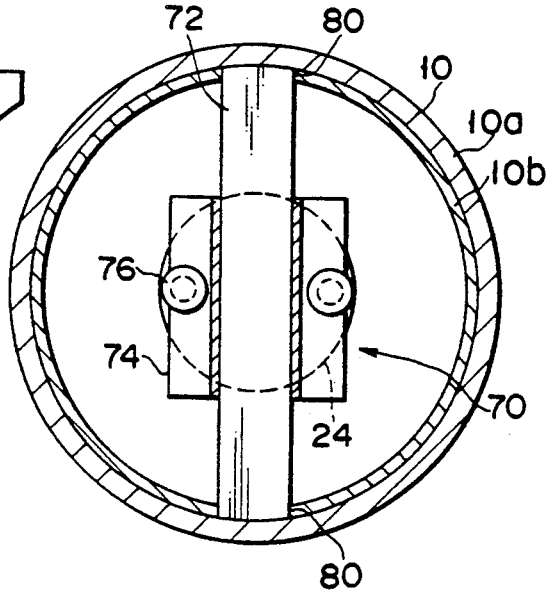
FIG. 10 is a view vertically-sectioned along a line X—X in FIG. 1.
Figure 11:
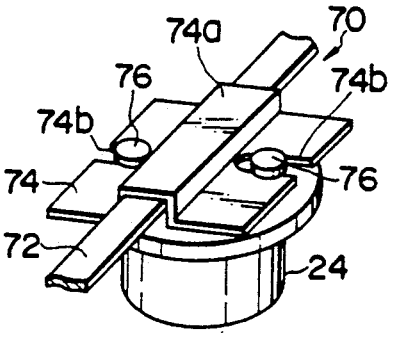
FIG. 11 is a perspective view showing a support system assembled.
Figure 12:
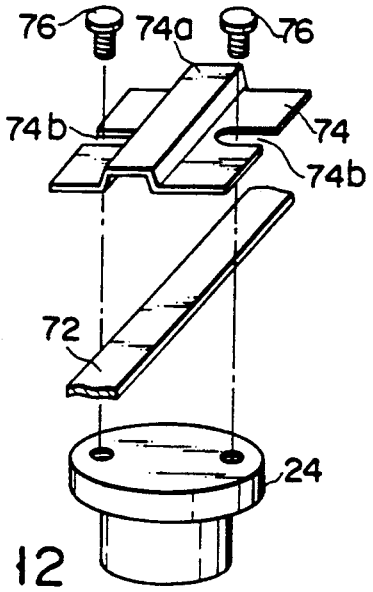
FIG. 12 is a perspective view showing the support system dismantled.

The support plate 72 of the support system 70 is fixed to the closed case 10, as shown in FIGS. 9 and 10. The closed case 10 comprises a cylindrical case body 10*a* which is opened only at one end thereof, and a cover 10*b* which closes the open end of the case body 10*a*. The case body 10*a* is made a little thick but the cover 10*b* a little thin in this example. A stepped portion 78 is formed on the inner circumference of the case body 10 along the rim of the open end thereof and the open end of the cover 10*b* is seated on the stepped portion 78 of the case body 10*a* and fixed there by welding.

However, this fixing of the cover 10*b* to the case body 10*a* is carried out after both ends of the support plate 72 which is a component of the support system are held between the stepped portion 78 along the rim of the open end of the case body 10*a* and the open end of the cover 10*b*.

A pair of key grooves 80 are formed at the open end of the cover 10*b* in this case. These key grooves 80 are located at the top and bottom of the cover 10*b* in the vertical direction and each of them has a width large enough to allow the end of the support plate 72 to be fitted.

Therefore, both ends of the support plate 72 are fitted in the key grooves 80 of the cover 10*b*. The open end of the cover 10*b* is then seated on the stepped portion 78 at the open end of the case body 10*a*. The case body 10*a* and the cover 10*b* are thus fixed to each other by welding.

This support system 70 can prevent the sub-bearing 24 from moving longer than a predetermined distance, for example, displacing a greater extent to the main bearing 22 when irregular and unbalanced force is added to the sub-bearing 24. The sub-bearing 24 is not pressed against the cylinder 20 and the piston 26, thereby preventing wearing loss from being caused. Because the support system 70 supports the sub-bearing 24 displaceable in such a range that the engaging screws 76 and the support plate 72 can move, the sub-bearing 24 can be moved on a plane substantially perpendicular to the axial center of the cylinder 20. Therefore, the assembly of the compressor can be more simply achieved using what extent the sub-bearing 24 can be moved.

Obviously, it may be arranged that the cover 10*b* is provided with the stepped portion 78 and that the case body 10*a* is provided with the key grooves 80.

Figure 13:
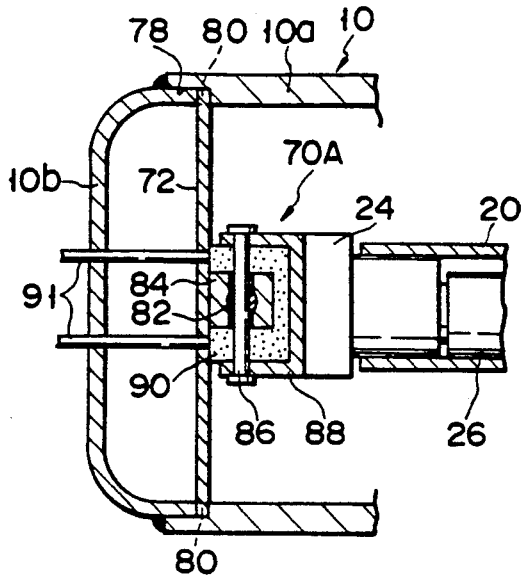
FIG. 13 is a vertically-sectioned view schematically showing the main portion of the fluid compressor which employs a first variation of the support system.
Figure 14:
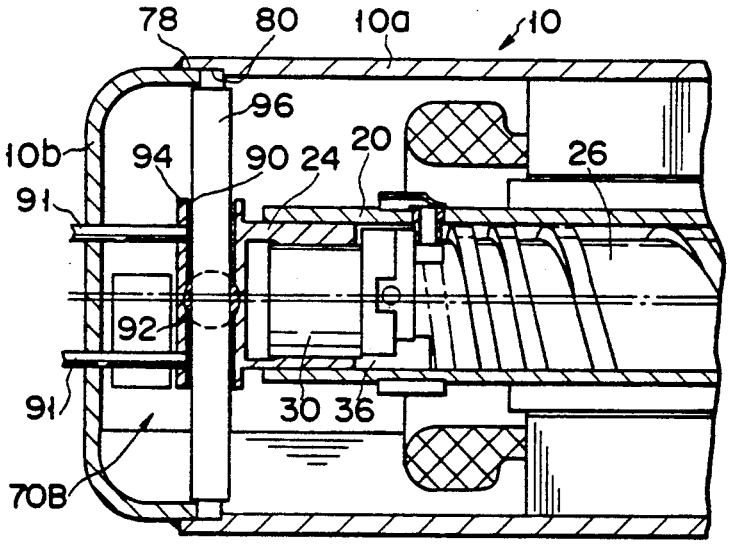
FIG. 14 is a vertically-sectioned view schematically showing the main portion of the fluid compressor which employs a second variation of the support system.
Figure 15:
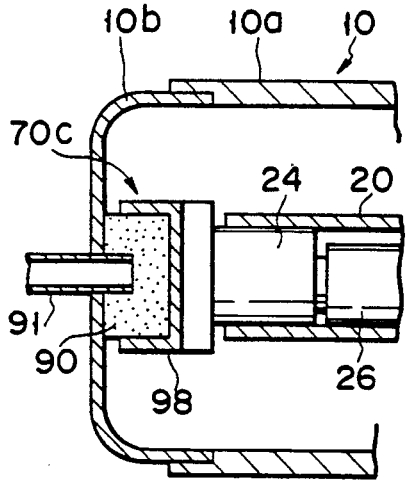
FIG. 15 is a vertically-sectioned view schematically showing the main portion of the fluid compressor which employs a third variation of the support system.

FIGS. 13 through 15 show variation of the support system.

In the case of the first variation 70A, the support plate 72 has an engaging member 84 provided with a slide pin 82. Further, the sub-bearing 24 includes an attaching member 88 provided with a support pin 86. The slide and support pins 82 and 86 cross each other in directions X and Y and their crossing position is on the axial center of the piston 26. Therefore, the support system 70A allows the sub-bearing 24 to be moved on a plane perpendicular to the axial centers of the cylinder 20 and the piston 26.

The support system 70A may be assembled in such a way that the sub-bearing 24 is adjusted in position to become parallel to the main bearing 22 and that adhesive is then supplied to the support system 70A through pipes 91. The fixing of the support plate 72 is carried out as described above. Namely, the support plate 72 is fitted in the key grooves 80 on the open rim of the cover 10*b* which is a component of the closed case 10, and the cover 10*b* is then seated and fixed on the stepped portion 78 along the open rim of the case body 10*a* with the support plate 72 sandwiched between them. The supply pipes 91 may be removed after the adhesive 90 is supplied to the support system 70A, and the case body 10*a* may be then closed by the cover 10*b*. Or the case body 10*a* may be closed by the cover 10*b*, leaving the pipes 91 as they are. It should be noted that the supply pipe 91 can be omitted when the adhesive 90 is deposited in the support system 70*a* before closing the case body 10*a* with cover 10*b*.

According to the support system 70A, the arrangement of rotatably supporting both ends of each of the cylinder 20 and the piston 26 can be provided. Even when force acts on the piston 26 sidewardly, therefore, no large moment is caused. Furthermore, same effect to that of the above-described embodiment can be obtained.

The second variation 70B shown in FIG. 14 is different from the first one 70A shown in FIG. 13 in that the support plate 72 is omitted.

In the case of this support system 70B, a support pin 96 is fixed directly to the closed case 10 at both ends thereof and passed through that hole of a slide pin 92, which extends in the longitudinal direction of the pin 92, at the intermediate portion thereof. The slide pin 92 is located between the sub-bearing 24 and a support plate 94 attached to the sub-bearing 24, extending in a direction perpendicular to the sheet of paper on which FIG. 14 is drawn. These support and slide pins 96 and 92 cross each other in the directions X and Y and their crossing position is on the axial center of the piston 26. As seen in the case of the support system 70A, the adhesive 90 may be filled in a clearance between the support pin 96 and the support plate 94 through the supply pipes 91.

In the case of the third variation 70C shown in FIG. 15, the supply pipe 91 is connected to the cover 10*b* of the closed case 10 and the adhesive 90 is supplied to the support system 70C through the supply pipe 91. The support system 70C is formed as a vessel 98 shaped like a fallen U in section to hold the sub-bearing 24. The support system 70C is adjusted to become parallel to the main bearing (not shown) and filled with the adhesive 90 supplied through the supply pipe 91 so that the support system 70C can be fixed directly to the cover 10*b*. According to this arrangement of the support system 70C, therefore, it is not required that the cover 10*b* be provided with the key grooves.

The operation of the above-described fluid compressor will be described.

As shown in FIG. 1, the rotor 18 is rotated and the cylinder 20 is also rotated together with the rotor 18 when the stator 16 at the drive section 12 is connected to the power source outside through the connector block 11.

The rotation of the cylinder 20 is transmitted to the piston 26 through the drive pin, the engaging groove 32 and the Oldham system 36. When the cylinder 20 is rotated the Oldham system 36 causes the Oldham seat 50 to be rotated at the same rotation speed at that of the cylinder 20 while displacing the Oldham ring 54 in the directions shown by arrows C in FIG. 2. Therefore, the rotation of the cylinder 20 is transmitted to the piston 26 through the Oldham system 36 and the piston 26 is rotated while being displaced relative to the Oldham ring 54 in the directions shown by arrows D in FIG. 2. The piston 26 is driven and rotated this time while contacting a part of its outer circumference with the inner circumference of the cylinder 20.

Because the outer circumference of the blade 40 is contacted with the inner circumference of the cylinder 20, the blade 40 is further pushed into the groove 38 as it comes nearer a point where the outer circumference of the piston 26 is contacted with the inner circumference of the cylinder 20 and it is further projected from the groove 38 as it comes more remote from that point. Therefore, the operating chambers 42 are made smaller and smaller in volume from right to left in FIG. 1. Cooling medium gas is sucked into the cylinder 20 through the sucking pipe 44 and the sucking hole 4 of the main bearing 22. The cooling medium gas thus sucked and shut in the operating chambers 42 is compressed further and further as the piston 26 is rotated, and it is then fed to the discharge chamber 43 The compressed cooling medium gas is discharged from the discharge chamber 43 into the space between the cylinder 20 and the closed case 10 through the discharging hole 94 of the Oldham seat 50 and the discharging hole 21 of the cylinder 20. It is then returned from the space in the closed case 10 into the refrigeration cycle through the discharging pipe 46.

When the closed case 10 is made high in pressure with the high pressure gas discharged, the lubricating oil 13 housed in the closed case 10 is urged into the lubricating oil supply passage 23 by the pressure in the closed case 10, as shown in FIG. 1. The lubricating oil 13 is supplied to the sliding portions of the bearings 22 and 24 relative to the cylinder 20 and the piston 26 and to the bottom of the groove 38 (FIG. 2), passing through the passage 23 and axial and radial supply passages (not shown) formed in the piston 26. The lubricating oil 13 lubricates those sliding portions between the cylinder 20, the piston 26 and the bearings 22, 24 and the lubricating oil 13 supplied to the bottom of the groove 38 urges the blade 40 against the inner circumference of the cylinder 20 to keep the operating chambers 42 and the discharging chamber 43 air-tight. The lubricating oil 13 which has functioned in this manner stays disposed along the inner circumference of the cylinder 42 by centrifugal force caused by the rotation of the cylinder 20, as shown in FIG. 3, and then is returned into the closed case 10, passing between the inner circumference of the cylinder 20 and the outer circumferences of the bearings 22, 24.

The oil 13 disposed on the inner circumference of the cylinder 20, as shown in FIG. 3, is partitioned by the Oldham seat 50 not to flow into the discharging hole 21 of the cylinder 20. The gas to be discharged is thus discharged outside the cylinder 20 under the condition that it is separated from the oil in the cylinder 20, passing through the discharging hole 62 of the Oldham seat 50 and the discharging hole 21 of the cylinder 20.

This can prevent the oil in the cylinder 20 from being discharged together with the gas discharged, so that a sufficient amount of the oil can be held in the cylinder 20. The sliding portions of the cylinder 20 and the piston 26 relative to the discharging and sucking sides bearings 24, 22, and those of the Oldham system 36, for example, can be therefore sufficiently lubricated, thereby preventing these sliding portions from becoming abnormally worn and creating noise.

Further, the oil is held in the cylinder 20, using the Oldham seat 50 of the Oldham system 36. This makes it unnecessary to use specific components for holding oil in the cylinder 20, thereby enabling the cylinder 20 and the piston 26 to be made simpler in structure.

Furthermore, the support system 70 for supporting the discharging sides of the cylinder 20 and the piston 26 supports the sub-bearing 24 freely movable in the plane perpendicular to the axial centers of the cylinder 20 and the piston 26 so as to hold the cylinder 20 and the piston 26 parallel to each other, as shown in FIG. 1. Therefore, the cylinder 20 and the piston 26 are regarded as being substantially supported at their both ends in their axial direction.

The support plate 72 of the support system 70 is fitted in key grooves 80 on the open rim of the cover 10*b* at the both ends thereof. Therefore, the support plate 72 can be positioned in the circumferential direction of the cylinder 20 and can be prevented from moving in the same direction. Further, the cover 10*b* is seated on the stepped portion 78 of the case body 10*a* and fixed there, sandwiching both ends of the support plate 72 between the cover 10*b* and the case body 10*a*. The support plate 72 is thus defined and positioned in the height direction thereof by the stepped portion 78 of the case body 10*a*.

Therefore, the cylinder 20 and the piston 26 are supported at their both ends in their axial direction by the case 10 through the bearings 22 and 24. The support system 70 for supporting the bearing 24 makes it unnecessary to attach and fix the support plate 72 directly to the cover 10*b*. This makes the attaching of the cover 10*b* and the sub-bearing 24 easier to thereby reduce the number of compressor assembling steps conducted. Further, undesired influence is not added to the support system 70 and the sub-bearing 24 at the time when the cover 10*b* is attached and fixed to the case body 10*a* by welding. This prevents these components from being thermally deformed. As the result, the compressing capacity of the compressor can be prevented from being lowered.

Apparently, the present invention can be applied a fluid compressor having a piston with two sets of spiral grooves and blades, and to other type compressors as well as refrigerating cycle devices.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A fluid compressor comprising:

a closed case having a case body provided with an open end and a cover for closing the open end of the case body to house drive and compressor sections therein, said compressor section including a cylinder having an axial line and first and second ends and being rotated by the drive section, a rotating body having an axial line offset relative to the axial line of the cylinder and a spiral groove opening at the outer surface thereof having a pitch that decrease at a predetermined rate and arranged to contact a part of the outer surface thereof with the inner surface of the cylinder, a spiral blade made of elastic material arranged in the groove of the rotating body to freely slide in the radial direction of the rotating body and provided with an outer surface closely contacting the inner surface of the cylinder to partition a space between the cylinder and the rotating body into plural operating chambers, and a rotation force transmitting system for connecting the cylinder and the rotating body to drive them;

a pair of fixing bearings, one of which is fixed to the closed case, serving to support the cylinder and the rotating body rotatable in relation to the closed case and close the first and second ends of the cylinder;

support means, having engaging means attached to the other of the paired bearings, for supporting the other bearing movable in relation to the closed case at least in a certain range on a plane perpendicular to axial center lines of the cylinder and the rotating body; and positioning means, formed at least at one of the case body and the cover, for positioning the engaging means relative to the closed case, said support means having a support plate for supporting the engaging means movable relative to the closed case in a certain range and said positioning means having means for positioning the support plate in the axial direction of the case body and a means for positioning the support plate in the circumferential direction of the cover.

2. The fluid compressor according to claim 1, wherein said engaging means is an engaging plate member provided with a guide groove for housing the support plate therein, movable in the axial direction thereof and fixed to the other bearing to be movable in a certain range in a direction perpendicular to the axial line of the support plate.

3. The fluid compressor according to claim 1, wherein the engaging means and the support plate are adhered to each other with the adhesive.

4. A fluid compressor comprising:

a close case having a case body provided with an open end and a cover for closing the open end of the case body to house drive and compressor sections therein, said compressor section including a cylinder having an axial line and first and second ends and being rotated by the drive section, a rotating body having an axial line offset relative to the axial line of the cylinder and a spiral groove opening at the outer surface thereof having a pitch that decrease at a predetermined rate and arranged to contact a part of the outer surface thereof with the inner surface of the cylinder, a spiral blade made of elastic material arranged in the groove of the rotating body to freely slide in the radial direction of the rotating body and having an outer surface closely contacting the inner surface of the cylinder to partition a space between the cylinder and the rotating body into plural operating chambers, and a rotation force transmitting system for connecting the cylinder and the rotation body to drive them;

a pair of fixing bearings, one of which is fixed to the closed case, serving to support the cylinder and the rotating body rotatable in relation to the closed case and close the first and second ends of the cylinder;

support means, having engaging means attached to the other of the paired bearings and for supporting the other bearing movable in relation to the closed case at least in a certain range on a plane perpendicular to axial center lines of the cylinder and the rotating body; and positioning means, formed at least at one of the case body and the cover, for positioning the engaging means relative to the closed case, said support means having a support plate for supporting the engaging means movable relative to the closed case in a certain range and side positioning means having means for positioning the support plate in the axial direction of the case body and a means for positioning the support plate in the circumferential direction of the cover, said axially positioning means having a stepped portion formed at one of the case body and the cover and an end of the other fitted into the stepped portion to sandwich both ends of the support plate therebetween, and said circumferentially positioning means having key grooves being formed on the end of the other of the case body and the cover, into which, both ends of the support plate being closely fitted.

5. A fluid compressor comprising:

a closed case having a case body provided with an open end and a cover for closing the open end of the case body to house drive and compressor sections therein, said compressor section including a cylinder having an axial line and first and second ends and being rotated by the drive section, a rotating body having an axial line offset relative to the axial line of the cylinder and a spiral groove opening at the outer surface thereof having a pitch that decrease at a predetermined rate and arranged to contact a part of the outer surface thereof with the inner surface of the cylinder, a spiral blade made of elastic material arranged in the groove of the rotating body to freely slide in the radial direction of the rotating body and having an outer surface closely contacting the inner surface of the cylinder to partition a space between the cylinder and the rotating body into plural operating chambers, and a rotation force transmitting system for connecting the cylinder and the rotating body to drive them;

a pair of fixing bearings, one of which is fixed to the closed case, serving to support the cylinder and the rotating body rotatable in relation to the closed case and close the first and second ends of the cylinder;

support means, having engaging means attached to the other of the paired bearings, for supporting the other bearing movable in relation to the closed case at least in a certain range on a plane perpendicular to axial center lines of the cylinder and the rotating body; and positioning means, formed at least at one of the case body and the cover, for positioning the engaging means relative to the closed case, said support means having a support plate for supporting the engaging means movable relative to the closed case in a certain range and side positioning means having means for positioning the support plate in the axial direction of the case body and a means for positioning the support plate in the circumferential direction of the cover, said support means including the engaging means fixed to the support plate and is provided with a slide pin, a support pin attached to the slide pin to be movable in a direction perpendicular to the axial direction of the slide pin, an attaching member fixed to the other bearing to hold both ends of the support pin, and a space formed between the attaching member and the engaging means to allow the attaching member and the support pin to move relative to the engaging means in the axial direction of the slide pin.

6. The fluid compressor according to claim 5, wherein the space can be supplied with adhesive to adhere into the space to bond the attaching member and the engaging means to each other after the support means is positioned relative to the closed case by the positioning means.

7. A fluid compressor comprising:

a closed case having a case body provided with an open end and a cover for closing the open end of the case body to house drive and compressor sections therein, said compressor section including a cylinder having an axial line and first and second ends and being rotated by the drive section, a rotating body having an axial line offset relative to the axial line of the cylinder and a spiral groove opening at the outer surface thereof having a pitch that decrease at a predetermined rate and arranged to contact a part of the outer surface thereof with the inner surface of the cylinder, a spiral blade made of elastic material arranged in the groove of the rotating body to freely slide in the radial direction of the rotating body and having an outer surface closely contacting the inner surface of the cylinder to partition a space between the cylinder and the rotating body into plural operating chambers, and a rotation force transmitting system for connecting the cylinder and the rotating body to drive them;

a pair of fixing bearings, one of which is fixed to the closed case, serving to support the cylinder and the rotating body rotatable in relation to the closed case and close the first and second ends of the cylinder;

support means, having engaging means attached to the other of the paired bearings, for supporting the other baring movable in relation to the closed case at least in a certain range on a plane perpendicular to axial center lines of the cylinder and the rotating body; and positioning means, formed at least at one of the case body and the cover, for positioning the engaging means relative to the closed case, said support means having a support plate for supporting the engaging means moveable relative to the closed case in a certain range and side positioning means having means for positioning the support plate in the axial direction of the case body and a means for positioning the support plate in the circumferential direction of the cover, said support means including a support pin, both ends thereof being positioned relative to the closed case by the positioning means, a slide pin provided with a transverse hole in which the support pin is held movable in axial line directions of the slide pin, and a support plate member for attaching the slide pin tot he other bearing to be movable in the axial direction thereof.

8. The fluid compressor according to claim 7, wherein the space can be supplied with adhesive to adhere the slide and support pins and to each other after the support means is positioned relative to the closed case by the positioning means.

9. A fluid compressor comprising:

a closed case having a case body provided with an open end and a cover for closing the open end of the case body to house drive and compressor sections therein, said compressor section including a cylinder having an axial line and first and second ends and being rotated by the drive section, a rotating body having an axial line offset relative to the axial line of the cylinder and a spiral groove opening at the outer surface thereof having a pitch that decrease at a predetermined rate and arranged to contact a part of the outer surface thereof with the inner surface of the cylinder, a spiral blade made of elastic material arranged in the groove of the rotating body to freely slide in the radial direction of the rotating body and provided with an outer surface closely contacted with the inner surface of the cylinder to partition a space between the cylinder and the rotating body into plural operating chambers, and a rotation force transmitting system for connecting the cylinder and the rotating body to drive them;

a pair of fixing bearings, one of which is fixed to the closed case, serving to support the cylinder and the rotating body rotatable in relation to the closed case and close the first and second ends of the cylinder;

support means, having engaging means attached to the other of the paired bearings, for supporting the other bearing movable in relation to the closed case at least in a certain range on a plane perpendicular to axial center lines of the cylinder and the rotating body; and positioning means, formed at least at one of the case body and the cover, for positioning the engaging means relative to the closed case, the first and second ends of the cylinder being respectively located on the sucking side and the discharging of the cylinder, and one of the pair of the bearing being located on the sucking side of the cylinder and the other bearing being located on the discharging side of the cylinder, wherein said cylinder has a discharging hole for communicating the operating chamber which is the highest in pressure with the closed case and said rotation force transmitting system includes a disk-like Oldham seat fixed in the cylinder while contacting its outer circumference with the inner circumference of the cylinder, and an Oldham ring is located on the discharging side of the rotating body and is arranged movable relative to the rotating body and the Oldham seat on a plane perpendicular to the axial line of the rotating body, and said Oldham seat has a hole extending in the radial direction thereof to communicate the discharging hole of the cylinder with the operating chamber which is the highest in pressure.

10. The fluid compressor according to claim 9, wherein said Oldham seat has a stopper against which the end of the blade is struck, and said rotating body has a recess in which the stopper is located.

11. The fluid compressor according to claim 10, wherein said recess is communicated with the operating chamber which is the highest in pressure, and said communicating hole is formed in the stopper.

12. A fluid compressor comprising:

a closed case having a case body provided with an open end and a cover for closing the open end of the case body to house drive and compressor sections therein, said compressor section including a cylinder having an axial line and first and second ends and being rotated by the drive section, a rotating body having an axial line offset relative to the axial line of the cylinder and a spiral groove opening at the outer surface thereof having a pitch that decrease at a predetermined rate and arranged to contact a part of the outer surface thereof with the inner surface of the cylinder, a spiral blade made of elastic material arranged in the groove of the rotating body to freely slide in the radial direction of the rotating body and having an outer surface closely contacting the inner surface of the cylinder to partition a space between the cylinder and the rotating body into plural operating chambers, and a rotation force transmitting system for connecting the cylinder and the rotating body to drive them;

a pair of fixing bearings, one of which is fixed to the closed case, serving to support the cylinder and the rotating body rotatable in relation to the closed case and close the first and second ends of the cylinder;

support means, having engaging means attached to the other of the paired bearings, for supporting the other bearing movable in relation to the closed case at least in a certain range on a plane perpendicular to axial center lines of the cylinder and the rotating body; and positioning means, formed at least at one of the case body and the cover, for positioning the engaging means relative to the closed case, said engaging means being of U-shaped cross-section and attached to said other baring of said paired bearings, said positioning means having pipes passing through the cover, an adhesive being applied to the pipes to fix the engaging means to the cover.

* * * * *